US008985749B2

(12) United States Patent
Watanabe

(10) Patent No.: US 8,985,749 B2
(45) Date of Patent: Mar. 24, 2015

(54) LIQUID EJECTION HEAD AND LIQUID EJECTION APPARATUS

(71) Applicant: Seiko Epson Corporation, Tokyo (JP)

(72) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/747,851

(22) Filed: Jan. 23, 2013

(65) Prior Publication Data

US 2013/0187991 A1 Jul. 25, 2013

(30) Foreign Application Priority Data

Jan. 24, 2012 (JP) ..... 2012-012491

(51) Int. Cl.
*B41J 2/045* (2006.01)
*B41J 2/14* (2006.01)

(52) U.S. Cl.
CPC ..... *B41J 2/14201* (2013.01); *B41J 2/14274* (2013.01); *B41J 2002/14362* (2013.01); *B41J 2002/14491* (2013.01)
USPC ..... 347/71

(58) Field of Classification Search
None
See application file for complete search history.

(56) References Cited

U.S. PATENT DOCUMENTS

2009/0185013 A1* 7/2009 Ito ..... 347/71
2009/0225137 A1* 9/2009 Fujishiro ..... 347/68
2011/0234701 A1 9/2011 Kobayashi et al.

FOREIGN PATENT DOCUMENTS

CN 102211457 10/2011
JP 2002-326362 11/2002
JP 2004-074740 3/2004

OTHER PUBLICATIONS

Sealants and Adhesives, Paragraphs 1 and 3 under Extraordinary Versatility, Jun. 2007.*
Google Internet search—Intersect, paragraph 1-2 (first two definitions).*

* cited by examiner

*Primary Examiner* — Lisa M Solomon
(74) *Attorney, Agent, or Firm* — Workman Nydegger

(57) ABSTRACT

A liquid ejection head includes a flow path unit having pressure generating chambers, a case head that is mounted to the flow path unit, and a piezoelectric element unit having a fixation member and piezoelectric elements, an adhesive surface of the fixation member being adhered to the case head by using a first adhesive and a second adhesive, and the piezoelectric elements being bonded to a piezoelectric element attachment surface of the fixation member which intersects the adhesive surface and also attached to islands that oppose the pressure generating chambers of the flow path unit, wherein the second adhesive has curing time shorter than that of the first adhesive, and the first adhesive has adhesion strength higher than that of the second adhesive and is applied on a first adhesive surface on the adhesive surface of the fixation member which is subject to a reaction force of the piezoelectric elements.

13 Claims, 7 Drawing Sheets

LIQUID EJECTION HEAD AND LIQUID EJECTION APPARATUS

BACKGROUND

1. Technical Field

The present invention relates to liquid ejection heads and liquid ejection apparatuses, and more specifically to ink jet recording heads and ink jet recording apparatuses that eject ink as a liquid.

2. Related Art

Ink jet recording heads that eject ink droplets from nozzles by using pressure, for example, generated by deformation of piezoelectric elements are known as a typical example of liquid ejection head. Specifically, as described in JP-A-2004-74740, an ink jet recording head includes a flow path unit in which pressure generating chambers that communicate with nozzles are formed and having a flow path forming plate and a vibration plate disposed on one face of the flow path forming plate, piezoelectric elements (piezoelectric transducers) secured to the fixation plate corresponding to the respective pressure generating chambers, and a case head (structure) having a housing chamber in which the fixation plate is mounted.

In such an ink jet recording head, the fixation plate and the case head are bonded together with an adhesive such as epoxy resin adhesive after the respective piezoelectric elements are positioned so as to oppose the respective pressure generating chambers.

However, it takes a long time for epoxy resin adhesive to cure and the positioning needs to be retained by using a jig and the like. Since the jig is in use for a long period of time for holding the ink jet recording head, it leads to decrease of manufacturing efficiency. If a number of jigs are used to improve the efficiency, it leads to increase of manufacturing cost.

Further, if a jig is not used, the piezoelectric elements are displaced from the respective pressure generating chambers before the epoxy resin adhesive cures. That is, the precision in positioning the piezoelectric elements relative to the pressure generating chambers decreases, thereby causing a problem that desired ink ejection properties cannot be achieved.

Such a problem exists not only in ink jet recording heads but only in liquid ejection heads that eject a liquid other than ink.

SUMMARY

An advantage of some aspects of the invention is that liquid ejection heads and liquid ejection apparatuses that can be manufactured in a simplified process and have improved liquid ejection characteristics by preventing displacement between piezoelectric elements and pressure generating chambers are provided.

According to an aspect of the invention, a liquid ejection head includes a flow path unit having a plurality of pressure generating chambers that communicate with nozzles through which liquid is ejected; a case head that is mounted on the flow path unit; and a piezoelectric element unit having a fixation member and piezoelectric elements, one face of the fixation member being adhered to the case head by using a first adhesive and a second adhesive, and the piezoelectric elements being bonded to the fixation member and also attached to areas that oppose the pressure generating chambers of the flow path unit, wherein the second adhesive has curing time shorter than that of the first adhesive and is applied on a first area on the one face of the fixation member, the first adhesive has adhesion strength higher than that of the second adhesive and is applied on a second area on the one face of the fixation member, and the second area is subject to a reaction force larger than the first area. With this configuration, the first adhesive having high adhesion strength is applied on the area which is subject to a reaction force of the piezoelectric elements. Accordingly, it is possible to prevent the fixation member from being removed or displaced from the case head, even when the reaction force of the piezoelectric elements acts on the fixation member. Therefore, it is possible to prevent the piezoelectric elements from being displaced from the area that opposes the pressure generating chambers, thereby providing the liquid ejection head having improved liquid ejection characteristics. Further, when the piezoelectric element unit is positioned on the case head and bonded by using the first adhesive and the second adhesive, the second adhesive instantly cures after the positioning. Accordingly, the positioning of the piezoelectric element unit can be retained until the first adhesive cures. Therefore, it is possible to prevent the piezoelectric elements from being displaced from the area that opposes the pressure generating chambers during the time period from the positioning of the piezoelectric element unit to curing of the first adhesive, thereby providing the liquid ejection head having improved liquid ejection characteristics.

It is preferable that the piezoelectric elements are provided corresponding to each of the plurality of pressure generating chambers that are arranged in one direction, the first adhesive is applied on a first adhesive surface on the one face of the fixation member that overlaps the piezoelectric elements in the one direction, and the second adhesive is applied on a second adhesive surface that is provided on the outer side of the first adhesive surface. With this configuration, the first adhesive surface which is subject to the reaction force of the piezoelectric elements and the second adhesive surface which is not subject to the reaction force of the piezoelectric elements are adhered to the case head by using the first adhesive and the second adhesive, respectively.

Further, it is preferable that the piezoelectric element unit has a non-deforming section that does not deform disposed on the outer side of the piezoelectric elements in the one direction, the second adhesive surface has an area that overlaps the non-deforming section in the one direction on the one face of the fixation member, and the second adhesive is applied on the entire second adhesive surface. With this configuration, the first adhesive having high adhesion strength is applied on the entire first adhesive surface which is subject to the reaction force. Accordingly, displacement of the fixation member due to the reaction force can be more reliably prevented. Moreover, in the adhesive surfaces of the fixation member to the case head, the second adhesive surface for temporary fixation by the second adhesive can be maximized. Accordingly, temporary fixation by the second adhesive can be enhanced.

Further, it is preferable that the first adhesive is a thermosetting adhesive, and the second adhesive is an ultraviolet curable adhesive or an instant adhesive. With this configuration, it is possible to more strongly adhere the fixation member and the case head on the first adhesive surface, and more quickly adhere the fixation member and the case head on the second adhesive surface.

According to another aspect of the invention, a liquid ejection apparatus includes the liquid ejection head according to the above aspect. With this configuration, manufacturing process can be simplified, and displacement between the piezoelectric elements and the pressure generating chambers can be prevented, thereby providing the liquid ejection apparatus having improved liquid ejection characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
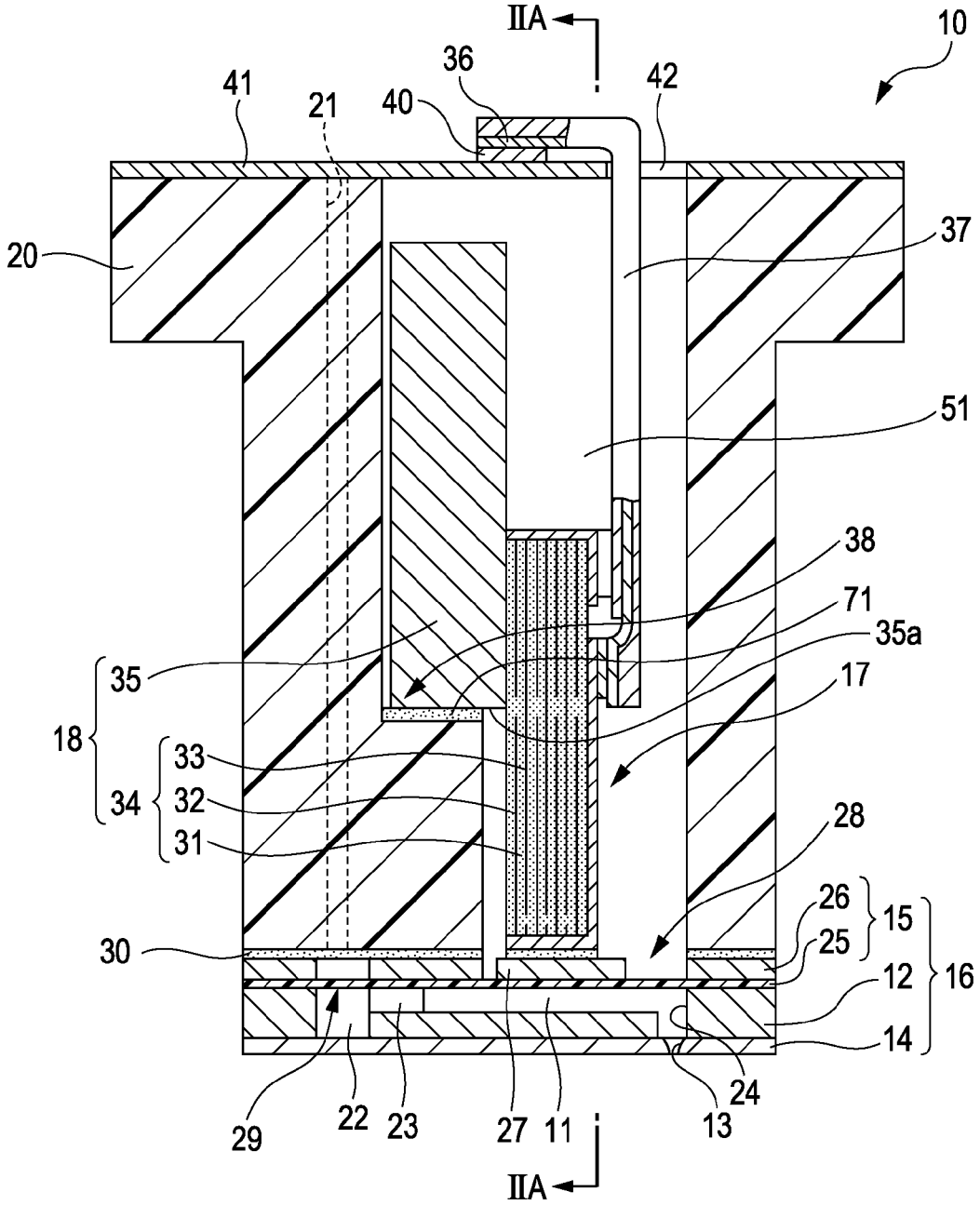
FIG. 1 is a sectional view of an ink jet recording head according to a first embodiment.
Figure 2A:
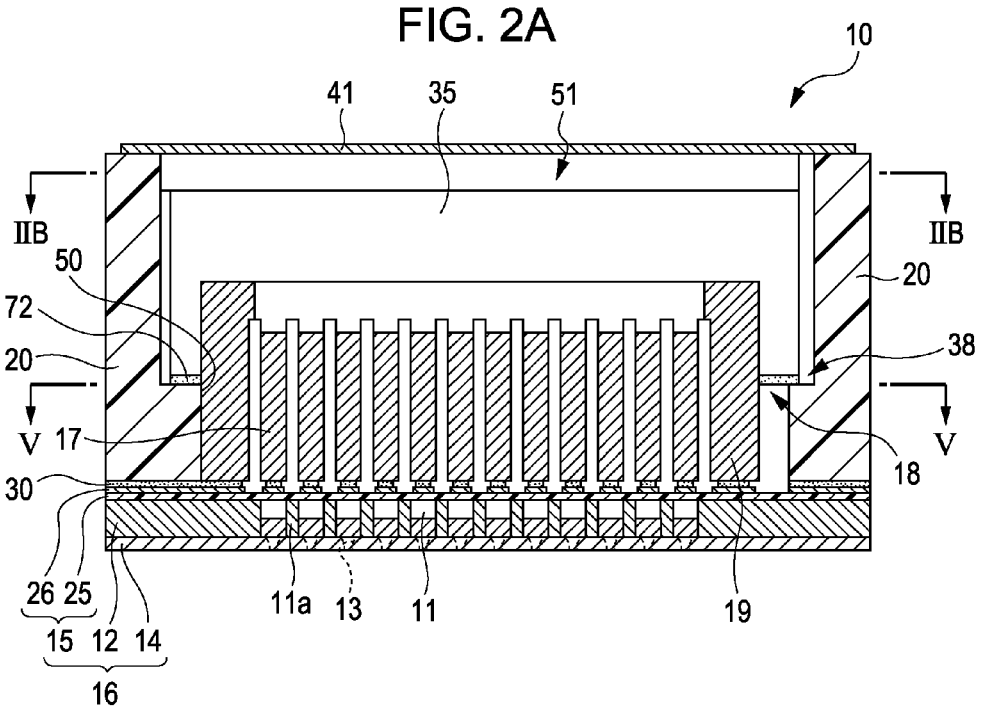
FIGS. 2A and 2B are sectional views of the ink jet recording head according to the first embodiment.
Figure 2B:
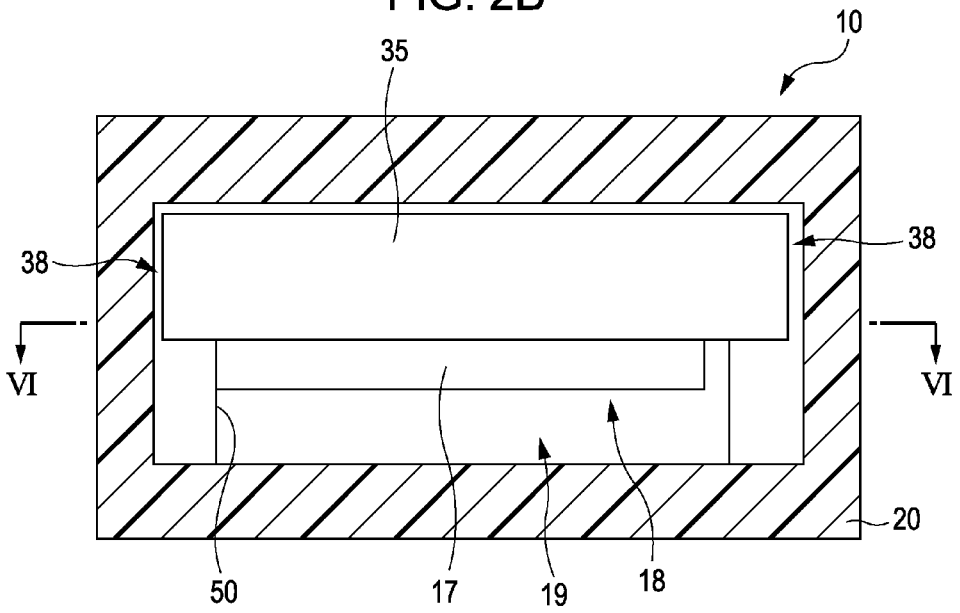

The invention will be described in detail with reference to an embodiment. FIG. 1 is a sectional view in short direction of a pressure generating chamber of an ink jet recording head as an example of liquid ejection head according to a first embodiment of the invention. FIG. 2A is a sectional view taken along the line IIA-IIA of FIG. 1, and FIG. 2B is a sectional view taken along the line IIB-IIB of FIG. 2A.

As shown in the figure, an ink jet recording head 10 includes a flow path unit 16 that has a flow path forming substrate 12 having a plurality of pressure generating chambers 11, a nozzle plate 14 in which a plurality of nozzles 13 that communicate with the respective pressure generating chambers 11 are formed by drilling, and a vibration plate 15 disposed on the flow path forming substrate 12 opposite to the nozzle plate 14. The ink jet recording head 10 further includes a piezoelectric element unit 18 that has piezoelectric elements 17 disposed in areas corresponding to the respective pressure generating chambers 11 on the vibration plate 15, and a case head 20 that is secured to the vibration plate 15 and has a containing section 51 for housing the piezoelectric element unit 18.

The plurality of pressure generating chambers 11 which are separated by partitions 11*a* are arranged in the width direction on a surface layer of one face of the flow path forming substrate 12. A reservoir 22 that penetrates the flow path forming substrate 12 in the thickness direction is formed in the outside area of the array of pressure generating chambers 11 such that ink is supplied through an ink introduction path 21 which is a liquid introduction path of the case head 20. The reservoir 22 communicates with the respective pressure generating chambers 11 via ink supply paths 23. Ink is supplied to the respective pressure generating chambers 11 via the ink introduction path 21, the reservoir 22 and ink supply paths 23. Further, nozzle communication holes 24 that penetrate the flow path forming substrate 12 are formed at the end of the pressure generating chambers 11 opposite to the reservoir 22. That is, in this embodiment, the pressure generating chambers 11, the reservoir 22, the ink supply paths 23 and the nozzle communication holes 24 are formed in the flow path forming substrate 12 as a liquid flow path. In this embodiment, the flow path forming substrate 12 is formed of a silicon single crystal substrate. The pressure generating chambers 11 and the like are formed on the flow path forming substrate 12 by etching the flow path forming substrate 12.

The nozzle plate 14 in which the nozzles 13 are formed by drilling is bonded on one face of the flow path forming substrate 12 such that the respective nozzles 13 communicate with the respective pressure generating chambers 11 via nozzle communication holes 24 formed in the flow path forming substrate 12.

The vibration plate 15 is bonded on the other face of the flow path forming substrate 12, that is, the surface having openings of the pressure generating chambers 11 such that the respective pressure generating chambers 11 are sealed by the vibration plate 15.

The vibration plate 15 is a composite plate formed of an elastic film 25 and a support plate 26, and is bonded to the flow path forming substrate 12 on the side of the elastic film 25. For example, the elastic film 25 is made of an elastic member such as a resin film, while the support plate 26 is made of a material such as metal. Further, islands 27 are formed in areas of the vibration plate 15 that oppose the respective pressure generating chambers 11, and the distal end of each piezoelectric element 17 abuts against the island 27. That is, thin-walled portions 28 having a thickness that is thinner than other area are formed in areas of the vibration plate 15 that oppose the peripheral areas of the respective pressure generating chambers 11 such that each island 27 is surrounded by the thin-walled portion 28.

Further, a compliance section 29 is formed in an area of the vibration plate 15 that opposes the reservoir 22. The compliance section 29 is formed by etching the support plate 26 in a similar manner to the thin-walled portion 28 and substantially made of the elastic film 25 only. In the compliance section 29, when a pressure change occurs in the reservoir 22, the elastic film 25 of the compliance section 29 deforms to absorb the pressure change so as to keep a constant pressure in the reservoir 22.

Figure 3A:
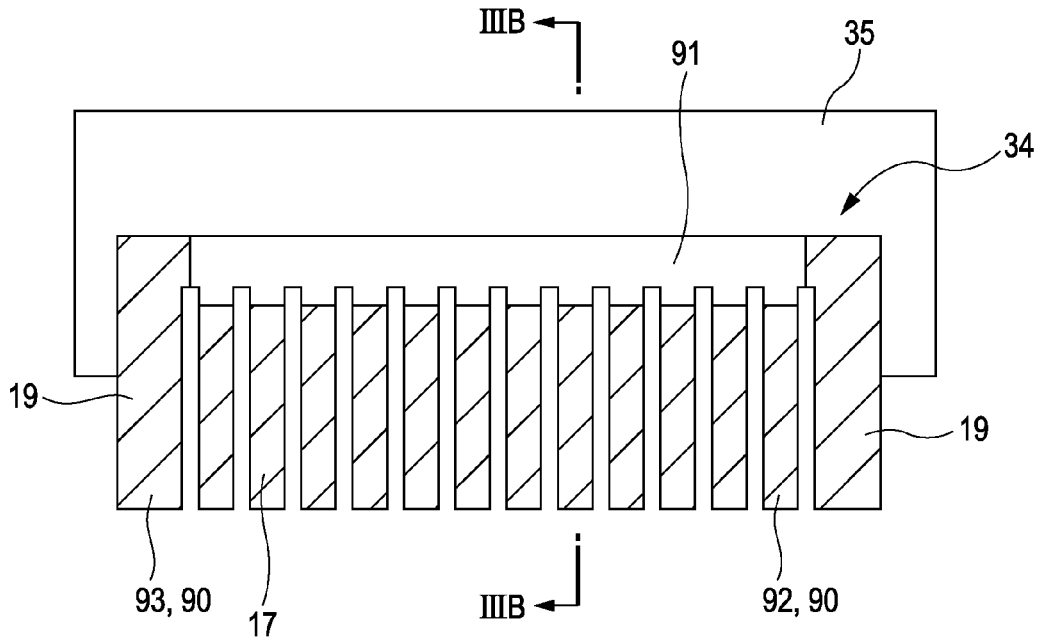
FIG. 3A is a front view of a piezoelectric element unit according to the first embodiment.
Figure 3B:
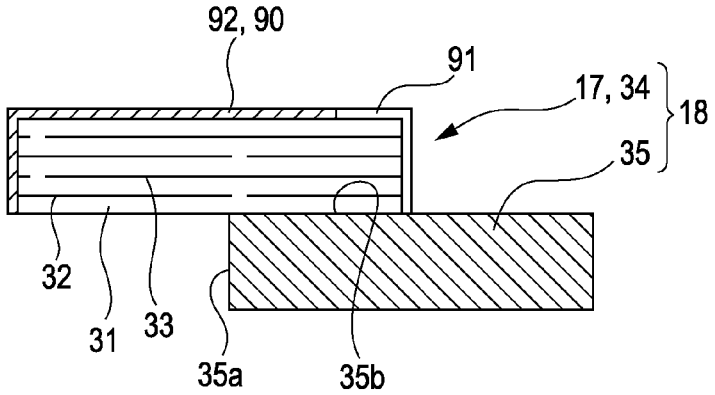
FIG. 3B is a sectional view taken along the line IIIB-IIIB of FIG. 3A.
Figure 4:
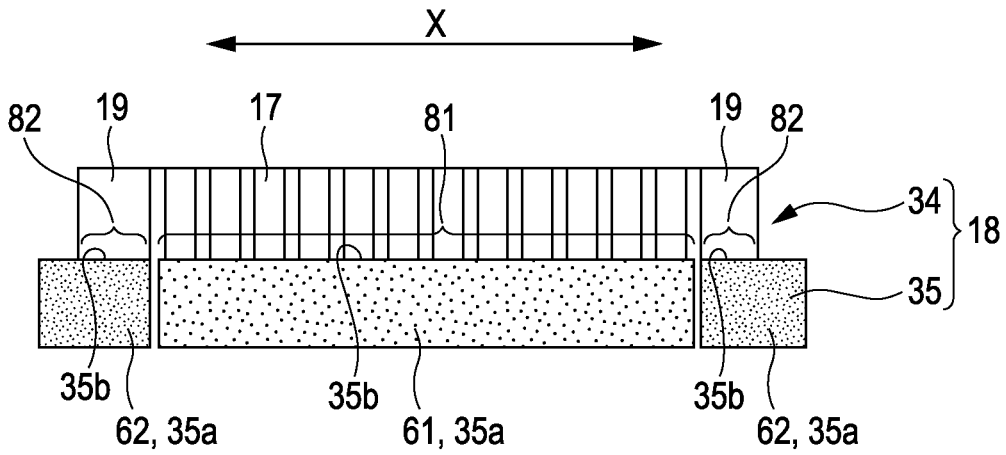
FIG. 4 is a bottom view of the piezoelectric element unit according to the first embodiment.

The piezoelectric element unit 18 will be described with reference to FIGS. 3A, 3B and 4. FIG. 3A is a front view of the piezoelectric element unit 18, FIG. 3B is a sectional view taken along the line IIIB-IIIB of FIG. 3A, and FIG. 4 is a bottom view of the piezoelectric element unit 18. In FIG. 4, an external electrode 90 (individual external electrodes 92 and common external electrodes 93) are not shown.

The piezoelectric element unit 18 includes a piezoelectric element forming member 34 and a fixation member 35. In the piezoelectric element forming member 34, a plurality of piezoelectric elements 17 are arranged in the width direction. The distal end (one end) of the piezoelectric element forming member 34 serves as a free end, while the proximal end (the other end) of the piezoelectric element forming member 34 is bonded to the fixation member 35 as a fixed end.

The piezoelectric element forming member 34 includes piezoelectric materials 31, internal electrodes that form two poles of the piezoelectric elements 17, that is, individual internal electrodes 32 that form internal electrodes electrically independent from the adjacent piezoelectric elements 17, and common internal electrodes 33 that form common electrodes common to the adjacent piezoelectric elements 17, which are sequentially stacked.

In the piezoelectric element forming member 34, the piezoelectric elements 17 separated into a comb-like shape, for example, by a wire saw are arranged in an array so as to oppose the respective pressure generating chambers 11. Positioning sections 19 each having a width greater than that of each piezoelectric element 17 are formed on both outer sides of the array of the piezoelectric elements 17. The positioning sections 19 are formed such that voltage is not applied thereto and do not deform. The positioning sections 19 are provided for positioning the piezoelectric element unit 18 with high precision when the piezoelectric element unit 18 is assembled to the ink jet recording head 10.

The external electrode 90 that is connected to the individual internal electrodes 32 and the common internal electrodes 33 is formed on the outer surface of the piezoelectric element forming member 34. Further, a non-electrode forming section 91 is formed on the portion of piezoelectric element forming member 34 in an area other than the external electrode 90, which at least corresponds to the proximal end of the piezoelectric elements 17.

The external electrode 90 includes the individual external electrodes 92 formed by providing the non-electrode forming section 91 and separating the piezoelectric elements 17 into a comb-like shape and electrically independent from the adjacent piezoelectric elements 17, and common external electrodes 93 common to the adjacent piezoelectric elements 17.

Specifically, the external electrode 90 is divided into a portion that opposes the piezoelectric elements 17 and a portion that opposes the positioning sections 19. The portion of the external electrode 90 that opposes the piezoelectric elements 17 is electrically connected to the individual internal electrodes 32 that form individual electrodes of the piezoelectric elements 17 at the distal end of the piezoelectric element forming member 34, thereby forming the individual external electrodes 92. On the other hand, the portion of the external electrode 90 on the positioning sections 19 that is formed on both outer sides of the array of the piezoelectric elements 17 is connected to the common internal electrodes 33 that form common electrodes of the piezoelectric elements 17 at the proximal end of the piezoelectric element forming member 34, thereby forming the common external electrodes 93.

The fixation member 35 is made of a material such as a resin. The above described piezoelectric element forming member 34 (the piezoelectric elements 17) is bonded to the fixation member 35, and the fixation member 35 is adhered to the case head 20. That is, an adhesive surface 35*a* which is one face of the fixation member 35 is adhered to the case head 20 by a first adhesive 71 and a second adhesive 72 which will be described later. The piezoelectric element forming member 34 (the piezoelectric elements 17) is bonded on the other face of the fixation member 35 which intersects with the adhesive surface 35*a* (hereinafter, referred to as a piezoelectric element attachment surface 35*b*).

As shown in FIG. 4, the piezoelectric elements 17 are arranged in one direction (hereinafter, referred to as arrangement direction X), and the positioning sections 19 (non-deforming sections) that do not deform by application of voltage are provided on both sides of the piezoelectric elements 17 in the arrangement direction X.

In the piezoelectric element unit 18, when the piezoelectric elements 17 deform, a reaction force is applied from the fixation end of the piezoelectric elements 17 to the piezoelectric element attachment surface 35*b* of the fixation member 35. More specifically, the reaction force is applied to the area of the piezoelectric element attachment surface 35*b* on which the piezoelectric elements 17 are bonded (hereinafter, referred to as first area 81), while the reaction force is not applied to the area of the piezoelectric element attachment surface 35*b* on which the positioning sections 19 are bonded (hereinafter, referred to as second area 82).

The reaction force applied to the first area 81 has an effect to the adhesive surface 35*a*. The area of the adhesive surface 35*a* that overlaps the piezoelectric elements 17 in the arrangement direction X is defines as a first adhesive surface 61. That is, the size (width) and position of the area on the piezoelectric elements 17 in the arrangement direction X are substantially same as the size (width) and position of the area on the first adhesive surface 61 in the arrangement direction X.

The reaction force of the piezoelectric elements 17 applied to the first area 81 acts on the first adhesive surface 61. In this embodiment, the adhesive surface 35*a* is vertical to the piezoelectric element attachment surface 35*b* as shown in FIG. 3B. In this case, when the reaction force of the piezoelectric elements 17 is applied to the first area 81 of the fixation member 35, it acts on the first adhesive surface 61 as a force in the parallel direction, that is, a shear force. Accordingly, as will be described later in detail, the reaction force of the piezoelectric elements 17 acts on the first adhesive surface 61 to displace the fixation member 35 adhered to the case head 20. Although the adhesive surface 35*a* is described as being vertical to the piezoelectric element attachment surface 35*b*, it is not limited thereto since the reaction force of the piezoelectric elements 17 acts on the first adhesive surface 61 of the fixation member 35 as a shear force in the case where the adhesive surface 35*a* is not vertical to the piezoelectric element attachment surface 35*b*.

On the other hand, the reaction force of the piezoelectric elements 17 is not applied to the second area 82, and therefore does not act as a force to shear the second adhesive surface 62. Accordingly, as will be described later in detail, the reaction force of the piezoelectric elements 17 does not act on the second adhesive surface 62 to displace the fixation member 35 adhered to the case head 20.

With further reference to FIGS. 1, 2A, and 2B the piezoelectric element unit 18 is mounted with the distal end of the piezoelectric elements 17 abutting against the islands 27 of the vibration plate 15. Moreover, the case head 20 is secured to the vibration plate 15, and the piezoelectric element unit 18 is secured to the case head 20.

The containing section 51 is formed in the case head 20 in the area that opposes the islands 27 so as to penetrate in the thickness direction. The containing section 51 houses the piezoelectric element unit 18. Further, the containing section 51 of the case head 20 has a stepped portion 38 formed therein such that the side of the vibration plate 15 is narrower. The fixation member 35 is adhered on the inner surface of the case head 20 at the stepped portion 38 by using a first adhesive 71 and a second adhesive 72. The adhesion between the fixation member 35 and the case head 20 by using the first adhesive 71 and second adhesive 72 will be described later in detail.

The case head 20 is made of, for example, a resin material. The inner surface of the containing section 51 of the case head 20 serves as an alignment surface 50 against which at least a portion of the side surface of the piezoelectric element unit 18 abuts. The alignment surface 50 is an inner surface of the containing section 51 at one end of the arrangement direction of the pressure generating chambers 11 such that the positioning section 19 at one end of the arrangement direction of the piezoelectric elements 17 abuts against the alignment surface 50. The plurality of pressure generating chambers 11 are arranged in the short direction (width direction), and the plurality of piezoelectric elements 17 are arranged in the short direction (width direction) of their end face, corresponding to the plurality of pressure generating chambers 11. That is, the arrangement direction of the piezoelectric elements 17 is the short direction of the end face that is attached to the islands 27, such that the positioning of the short direction of the piezoelectric elements 17 and the short direction of the islands 27 is achieved by abutting the positioning section 19 against the alignment surface 50 of the case head 20.

Both the width of the island 27 in the short direction and the width of the piezoelectric elements 17 in the short direction are on the order of tens of micrometers and both are formed with substantially the same width. Accordingly, if the high-precise positioning of the short direction of the piezoelectric elements 17 and the short direction of the islands 27 fails, the displacement of the piezoelectric elements 17 is not transmitted to the vibration plate 15 via the islands 27, leading to deterioration in ink ejection characteristics.

In this embodiment, since the positioning is performed by abutting the alignment surface 50 of the case head 20 and the positioning sections 19, the piezoelectric elements 17 and the islands 27 are mounted with being precisely aligned relative to each other in the short direction, thereby achieving excellent ink ejection characteristics.

The piezoelectric element unit 18 mounted on the case head 20 is connected to a flexible wiring substrate 37 that supplies signals for driving the respective piezoelectric elements 17. The flexible wiring substrate 37 is electrically connected to the individual external electrodes 92 and the common external electrodes 93 of the piezoelectric elements 17.

A wiring substrate 41 is mounted on the case head 20 with a plurality of conductive pads 40 for connecting with wirings 36 of the flexible wiring substrate 37 disposed thereon, and the wiring substrate 41 substantially covers the containing section 51 of the case head 20. The wiring substrate 41 has a slit-shaped opening 42 in the area that opposes the containing section 51 of the case head 20, and the flexible wiring substrate 37 is drawn out through the opening 42 of the wiring substrate 41 to the outside of the containing section 51.

In this embodiment, the flexible wiring substrate 37 that forms the piezoelectric element unit 18 is made of, for example, a chip on film (COF) on which a driving IC (not shown in the figure) for driving the piezoelectric elements 17 is mounted. The proximal ends of the wirings 36 of the flexible wiring substrate 37 are connected to the individual external electrodes 92 and the common external electrodes 93 that form the piezoelectric elements 17, for example, by using solder, anisotropic conductive material or the like. On the other hand, the distal ends of the wirings 36 are connected to the respective conductive pads 40 of the wiring substrate 41. Specifically, the wirings 36 are connected to the respective conductive pads 40 of the wiring substrate 41 with the distal end of the flexible wiring substrate 37 that is drawn out through the opening 42 of the wiring substrate 41 to the outside of the containing section 51 is folded along the surface of the wiring substrate 41.

In the ink jet recording head 10, during ejection of ink droplets, the piezoelectric elements 17 and the vibration plate 15 deform so as to change the volume of the respective pressure generating chambers 11, thereby ejecting ink droplets from the specified nozzles 13. Specifically, when ink is supplied from the ink cartridge which is not shown in the figure to the reservoir 22, ink is distributed to the respective pressure generating chambers 11 via the ink supply paths 23. In practice, the piezoelectric elements 17 contract by applying voltage to the piezoelectric elements 17. This causes the vibration plate 15 to deform with the piezoelectric elements 17 so as to expand the volume of the pressure generating chambers 11, thereby drawing ink into the pressure generating chambers 11. When ink fills the pressure generating chambers 11 up to the nozzles 13, the voltage applied to the piezoelectric elements 17 is released in response to the recording signals supplied via the wiring substrate 41. Accordingly, as the piezoelectric elements 17 expand back to the initial state, the vibration plate 15 also deforms back to the initial state. As a result, the volume of the pressure generating chambers 11 contract, thereby increasing the pressure inside the pressure generating chambers 11 and ejecting ink droplets from nozzles 13.

Figure 5:
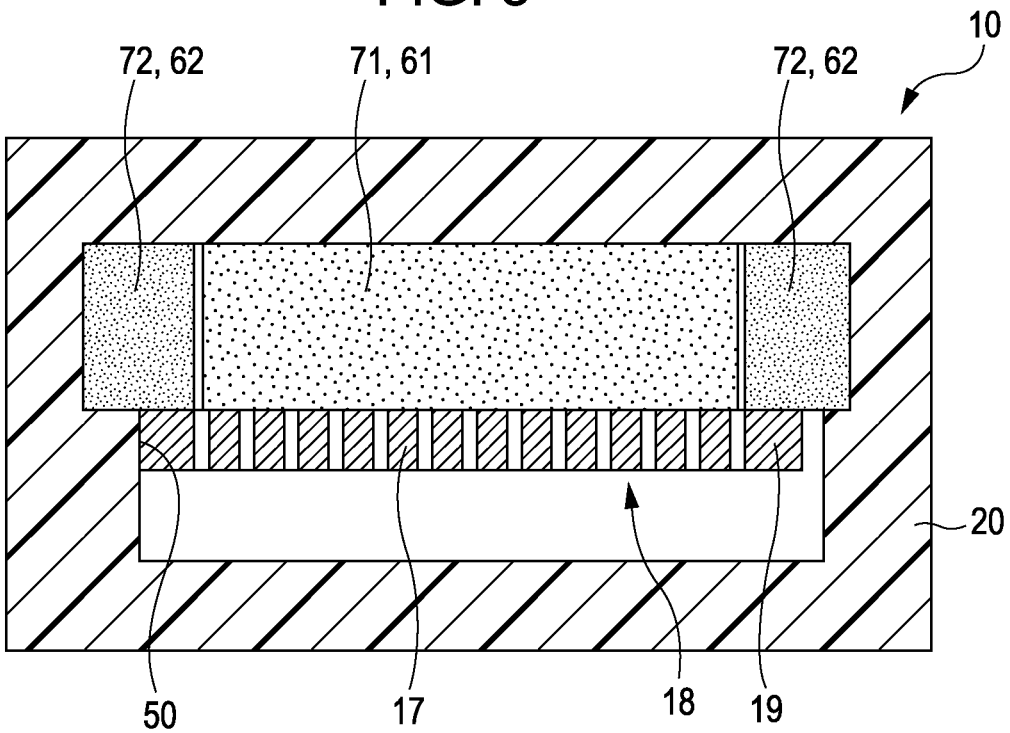
FIG. 5 is a sectional view taken along the line V-V of FIG. 2A.
Figure 6:
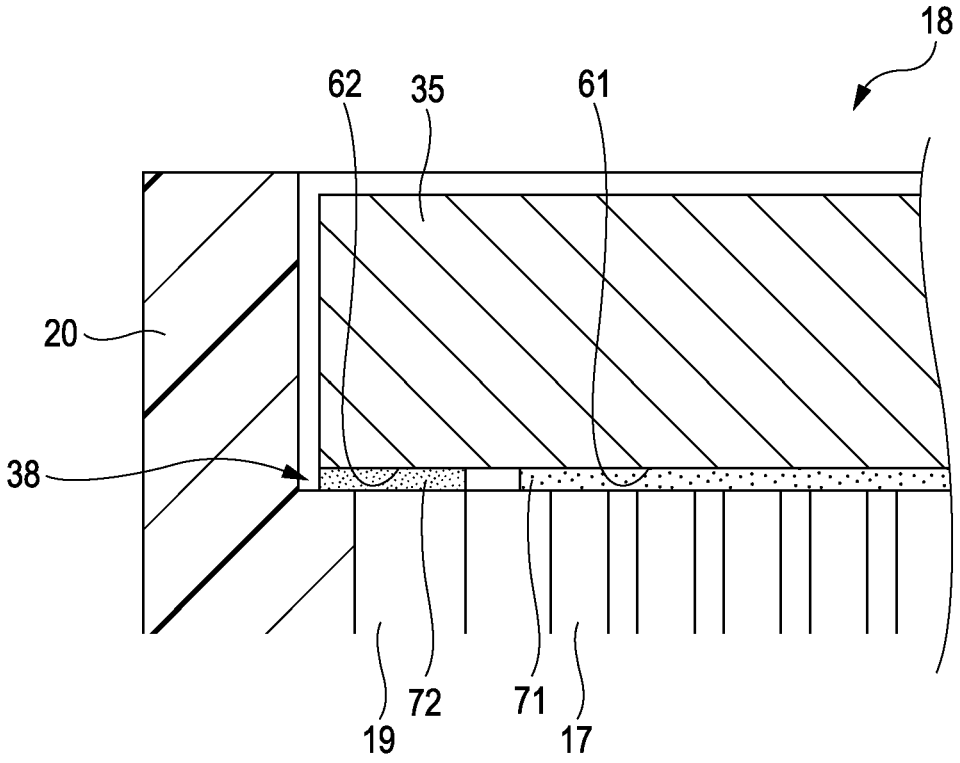
FIG. 6 is an enlarged view of an essential part of a section taken along the line VI-VI of FIG. 2B.

The adhesion between the piezoelectric element unit 18 and the case head 20 will be described in detail with reference to FIGS. 5 and 6. FIG. 5 is a sectional view taken along the line V-V of FIG. 2A, and FIG. 6 is an enlarged view of an essential part of a section taken along the line VI-VI of FIG. 2B.

As shown in the figures, the fixation member 35 is adhered on the surface of the stepped portion 38 of the case head 20 by using the first adhesive 71 and the second adhesive 72. More specifically, the first adhesive surface 61 of the adhesive surface 35*a* of the fixation member 35 and the stepped portion 38 are adhered by the first adhesive 71, while the second adhesive surface 62 of the adhesive surface 35*a* of the fixation member 35 and the stepped portion 38 are adhered by the second adhesive 72. In this embodiment, the first adhesive 71 is applied on the entire first adhesive surface 61 and the second adhesive 72 is applied on the entire second adhesive surface 62.

The first adhesive 71 has adhesion strength higher than that of the second adhesive 72. For example, the first adhesive 71 may be thermosetting adhesive such as an epoxy adhesive.

The second adhesive 72 has curing time shorter than that of the first adhesive 71. For example, ultraviolet curable adhesive or cyanoacrylate adhesive (instant adhesive) may be used.

As described above, the first adhesive surface 61 on which the first adhesive 71 is applied is the area on which the reaction force of the piezoelectric elements 17 acts. That is, the reaction force of the piezoelectric elements 17 acts on the first adhesive surface 61 to displace the fixation member 35 from the case head 20 (stepped portion 38). Since the first adhesive 71 having high adhesion strength is applied on the first adhesive surface 61, it is possible to resist the reaction force. That is, it is possible to prevent the fixation member 35 from being displaced from the case head 20.

On the other hand, as described above, the second adhesive surface 62 on which the second adhesive 72 is applied is the area on which the reaction force of the piezoelectric elements 17 does not act. Therefore, an adhesive having high adhesion strength is not necessary on the second adhesive surface 62, and the second adhesive 72 having a short curing time may be used. Accordingly, it is possible to perform positioning of the piezoelectric element unit 18 on the case head 20, temporarily fix the piezoelectric element unit 18 by using the second adhesive 72 applied on the second adhesive surface 62, and retain the positioning of the piezoelectric element unit 18 until the first adhesive 71 cures.

As described above, in the ink jet recording head 10 according to the invention, the first adhesive 71 and the second adhesive 72 are used for the first adhesive surface 61 on which the reaction force of the piezoelectric elements 17 acts and the second adhesive surface 62 on which the reaction force of the piezoelectric elements 17 does not act, respectively. This makes it possible to prevent the fixation member 35 from being removed or displaced from the case head 20, even when the reaction force due to the deformation of the piezoelectric elements 17 during ink ejection acts on the fixation member 35. As a result, it is possible to prevent the piezoelectric elements 17 from being displaced from the area that opposes the pressure generating chambers 11 (the islands 27), thereby providing the ink jet recording head 10 having improved ink ejection characteristics.

When the piezoelectric element unit 18 is positioned on the case head 20 and bonded on the first adhesive surface 61 and the second adhesive surface 62 by using the first adhesive 71 and the second adhesive 72, respectively, there is a risk that the piezoelectric element unit 18 may be displaced from the case head 20 due to contraction of the first adhesive 71. In this embodiment, since the second adhesive 72 instantly cures after the positioning of the piezoelectric element unit 18, the positioning of the piezoelectric element unit 18 can be retained until the first adhesive 71 cures. Therefore, it is possible to prevent the piezoelectric elements 17 from being displaced from the area that opposes the pressure generating chambers 11 (the islands 27) during the time period from the positioning of the piezoelectric element unit 18 to curing of the first adhesive 71, thereby providing the ink jet recording head 10 having improved ink ejection characteristics.

Moreover, since the piezoelectric element unit 18 and the case head 20 are temporarily fixed by the second adhesive 72, they do not need to be held by a jig or the like until the first adhesive 71 cures. That is, the piezoelectric element unit 18 and the case head 20 can be removed from the jig after the temporary fixation. Accordingly, the jig is not in use for a long period of time until the first adhesive 71 cures and can be used for manufacturing of other ink jet recording head 10. This eliminates the needs of a number of jigs, thereby decreasing the manufacturing cost.

Further, in this embodiment, the first adhesive 71 is applied on the entire first adhesive surface 61. That is, the first adhesive 71 having high adhesion strength is applied on all the area on which the reaction force of the piezoelectric elements 17 acts. Accordingly, displacement of the fixation member 35 due to the reaction force of the piezoelectric elements 17 can be more reliably prevented. In addition, the second adhesive 72 is applied on the entire second adhesive surface 62. That is, the area for temporary fixation by the second adhesive 72 can be maximized in the adhesive surface 35*a*. Accordingly, temporary fixation by the second adhesive 72 can be enhanced.

It should be noted that the first adhesive 71 is not necessarily applied on the entire first adhesive surface 61. For example, the first adhesive 71 may be applied on a portion of the first adhesive surface 61 as appropriate to the extent that the fixation member 35 is not displaced or removed from the case head 20 due to the reaction force of the piezoelectric elements 17 and the weight of the piezoelectric element unit 18. Likewise, the second adhesive 72 is not necessarily applied on the entire second adhesive surface 62. For example, the second adhesive 72 may be applied on a portion of the second adhesive surface 62 as appropriate to the extent that the positioning of the piezoelectric element unit 18 on the case head 20 can be retained.

Further, in the above embodiment, the second adhesive surface 62 is defined to include the portion of the adhesive surface 35*a* that overlaps the positioning sections 19 which is a non-deforming section in the arrangement direction X, however the second adhesive surface 62 is not limited thereto. For example, the portion of the adhesive surface 35*a* that overlaps the piezoelectric element forming member 34 (piezoelectric elements and the positioning sections 19) in the arrangement direction X may be defined as the first adhesive surface 61, and the remaining area may be defined as the second adhesive surface 62.

Other Embodiments

Figure 7:
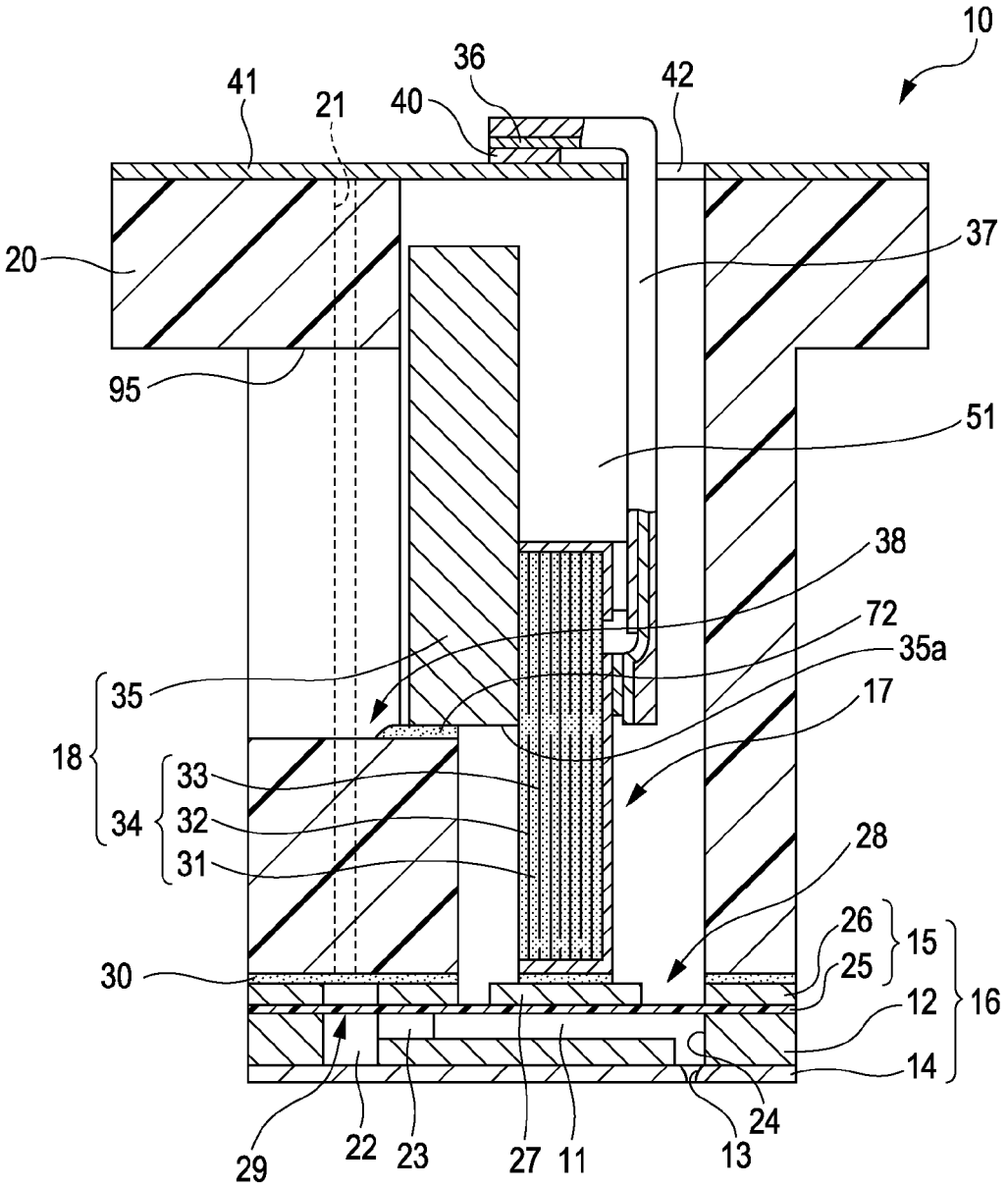
FIG. 7 is a sectional view of an ink jet recording head according to other embodiment.

Although the embodiment of the invention has been described above, the essential configuration of the invention is not limited thereto. FIG. 7 is a sectional view of an ink jet recording head 10 according to other embodiment. In the case where an ultraviolet curable adhesive is used as the second adhesive 72, an opening 95 that communicates with the containing section 51 may be formed in the case head 20 as shown in the figure. The ultraviolet light is irradiated to the adhesive surface 35*a* through the opening 95.

In manufacturing of the ink jet recording head 10, the first adhesive 71 such as an epoxy adhesive and the second adhesive 72 which is an ultraviolet curable adhesive are applied on the adhesive surface 35*a*, and then, the piezoelectric elements 17 are positioned so that the distal ends of the piezoelectric elements 17 are attached on the islands 27. Then, the ultraviolet light is irradiated to the adhesive surface 35*a* through the opening 95 so as to cure the second adhesive 72. As a result, temporary fixation by the second adhesive 72 can be performed after positioning of the piezoelectric element unit 18 is reliably performed. The opening 95 may be sealed after the second adhesive 72 cures.

Further, although the positioning sections 19 in the piezoelectric element unit 18 are disposed on both outer sides of the array of the piezoelectric elements 17 in the above embodiment, the positioning section 19 is not necessarily disposed in the piezoelectric element unit 18. In such a case, positioning of the piezoelectric element unit 18 can be performed by using other technique, for example, by aligning the optical images of the distal end of the piezoelectric elements 17 and the islands 27.

Figure 8:
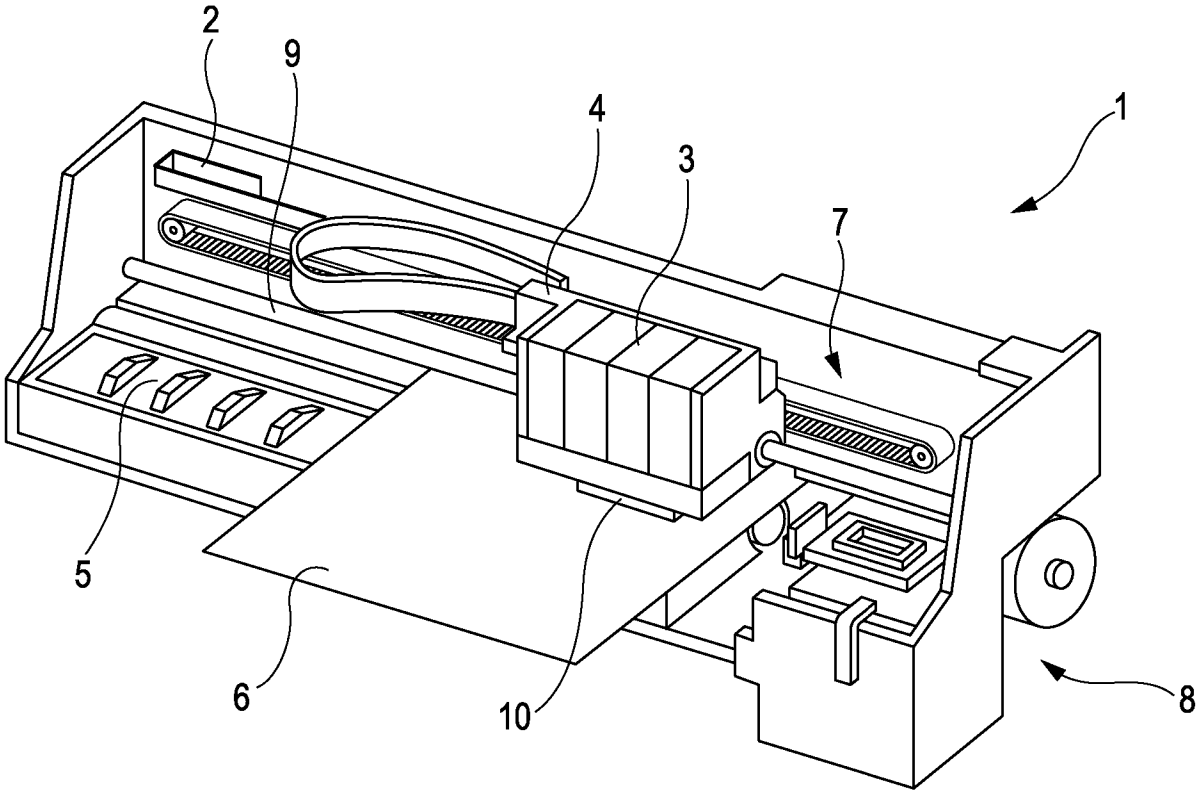
FIG. 8 is a schematic view of one example of an ink jet recording apparatus according to an embodiment.

The ink jet recording head described in the above embodiments is mounted in the ink jet recording apparatus and forms part of the recording head unit that is provided with ink flow paths that communicate with the ink cartridge and the like. FIG. 8 is a schematic view of one example of the ink jet recording apparatus.

The ink jet recording apparatus 1 includes the ink jet recording head 10. The ink jet recording head 10 and the ink cartridge 3 are mounted on the carriage 4, the carriage 4 is movable along a carriage shaft 9.

When a driving force from a driving motor (not shown) is transmitted to the carriage 4 through a plurality of gears and a timing belt 7, the carriage 4 on which the ink jet recording head 10 is mounted moves along the carriage shaft 9.

The position of the carriage 4 in the direction along the carriage shaft 9 is detected by a linear encoder 2, and the detection signal is sent to a controller (not shown) as positional information. The controller can control ink ejection operation and the like while recognizing the position of the carriage 4 (the ink jet recording head 10) based on the positional information from the linear encoder 2.

The ink jet recording apparatus 1 also includes a platen 5 such that a recording sheet 6 which is a recording medium such as a sheet of paper supplied from a sheet feeding mechanism 8 is transported onto the platen 5.

Although the ink jet recording head as an example of liquid ejection head and the liquid ejection apparatus as an example of ink jet recording apparatus have been described in the above embodiments, the invention is directed to the liquid ejection heads and the liquid ejection apparatuses in general and, as a matter of course, the invention can be applied to liquid ejection heads and liquid ejection apparatuses that eject a liquid other than ink. Example of other liquid ejection heads includes, for example, various recording heads used for image recording apparatuses such as a printer, color material ejection heads used for manufacturing of color filters such as a liquid crystal display, organic EL displays, electrode material ejection heads used for forming electrodes such as field emission displays (FED), and bioorganic ejection heads used for manufacturing bio chips. The invention also can be applied to liquid ejection apparatuses having such a liquid ejection head.

The entire disclosure of Japanese Patent Application No. 2012-012491, filed Jan. 24, 2012 is incorporated by reference herein.

What is claimed is:

1. A liquid ejection head comprising:

a vibration plate sealing a plurality of pressure generating chambers that communicate with nozzles through which liquid is ejected;

a case head that is mounted on the vibration plate;

piezoelectric elements that are mounted on the case head; and a fixation member bonded to the piezoelectric elements, wherein one face facing the vibration plate side of the fixation member is adhered to the case head by using a first adhesive and a second adhesive, and the piezoelectric elements are bonded to the fixation member at a surface that is transverse to the one face of the fixation member and wherein the piezoelectric elements are also attached to the vibration plate, wherein:

the first adhesive has adhesion strength higher than an adhesion strength of the second adhesive and the first adhesive is applied on a first adhesive surface on the one face of the fixation member overlapping the piezoelectric elements in an arrangement direction of the piezoelectric elements, the second adhesive has curing time shorter than a curing time of the first adhesive and the second adhesive is applied on a second adhesive surface on the one face of the fixation member does not overlap with the piezoelectric elements in the arrangement direction of the piezoelectric elements.

2. The liquid ejection head according to claim 1, wherein the piezoelectric elements are provided corresponding to each of the plurality of pressure generating chambers that are arranged in one direction, the first adhesive is applied on the first adhesive surface on the one face of the fixation member that corresponds to the piezoelectric elements arranged in the one direction, and the second adhesive is applied on the second adhesive surface that is provided on the outer side of the first adhesive surface.

3. The liquid ejection head according to claim 2, wherein the piezoelectric element unit has a non-deforming section that does not deform disposed in the outer side of the piezoelectric elements in the one direction, the second adhesive surface has an area that corresponds to the non-deforming section on the one face of the fixation member, and the second adhesive is applied on the entire second adhesive surface.

4. The liquid ejection head according to claim 1, wherein the first adhesive is a thermosetting adhesive, and the second adhesive is an ultraviolet curable adhesive or an instant adhesive.

5. A liquid ejection apparatus comprising the liquid ejection head according to claim 1.

6. A liquid ejection apparatus comprising the liquid ejection head according to claim 2.

7. A liquid ejection apparatus comprising the liquid ejection head according to claim 3.

8. A liquid ejection apparatus comprising the liquid ejection head according to claim 4.

9. The liquid ejection head according to claim 1, wherein the case head includes a stepped portion, wherein the one face of the fixation member is adhered to a surface of the stepped portion of the case head.

10. The liquid ejection head according to claim 1, wherein the first adhesive surface corresponds to a middle portion of the one face of the fixation member and the second adhesive surface corresponds to end portions of the fixation member.

11. The liquid ejection head according to claim 1, wherein the first adhesive surface corresponds to a portion of the fixation member supporting the piezoelectric elements and wherein the second adhesive surface corresponds to positioning sections that are configured for positioning the piezoelectric elements, wherein the positioning sections are formed on outer sides of the piezoelectric elements.

12. The liquid ejection head according to claim 1, wherein the fixation member bonded to the piezoelectric elements and to the case head, wherein only the one face of the fixation member is bonded to the case head.

13. The liquid ejection head according to claim 1, wherein the first adhesive surface is subject to a reaction force of the piezoelectric elements that is larger than a reaction force of the piezoelectric elements to which the second adhesive surface is subject.

* * * * *